US011767675B1

(12) United States Patent
Atias

(10) Patent No.: US 11,767,675 B1
(45) Date of Patent: Sep. 26, 2023

(54) CUSTOMIZABLE CLADDING SYSTEM AND METHOD

(71) Applicant: David Atias, Los Angeles, CA (US)

(72) Inventor: David Atias, Los Angeles, CA (US)

( * ) Notice: Subject to any disclaimer, the term of this patent is extended or adjusted under 35 U.S.C. 154(b) by 0 days.

(21) Appl. No.: 17/843,006

(22) Filed: Jun. 17, 2022

(51) Int. Cl.
*E04F 13/08* (2006.01)

(52) U.S. Cl.
CPC ..... *E04F 13/0812* (2013.01)

(58) Field of Classification Search
CPC ..... E04F 13/0812; E04F 13/0814; E04F 13/0816; E04B 9/26
See application file for complete search history.

(56) References Cited

U.S. PATENT DOCUMENTS 3,295,284 A * 1/1967 Tschiesche ..... E04F 13/0812 52/506.07
3,410,043 A * 11/1968 Rijnders ..... E04F 13/0812 52/762
3,417,530 A * 12/1968 Long ..... E04B 9/22 52/779
3,548,556 A * 12/1970 Vermeulen ..... E04B 9/363 52/669
4,157,000 A * 6/1979 Sutter ..... E04B 9/24 52/506.07
4,270,327 A * 6/1981 Van Leeuwen ..... E04B 9/363 52/762
4,328,653 A * 5/1982 Anderle ..... E04B 9/26 52/762
4,646,506 A * 3/1987 Slapsys ..... E04B 9/363 52/460
4,671,041 A * 6/1987 Rijnders ..... E04B 9/26 52/506.09
5,121,578 A * 6/1992 Holz ..... E04B 9/26 52/510
5,265,333 A * 11/1993 Lim ..... E04B 9/36 52/762
5,390,462 A * 2/1995 Kreiter ..... E04F 21/0069 52/506.01
5,423,155 A * 6/1995 Bauer ..... A47F 5/0846 52/510
5,477,645 A * 12/1995 Bauer ..... A47F 5/0846 52/146
6,050,041 A * 4/2000 Mowery ..... E04F 13/18 52/549
6,134,846 A * 10/2000 Lamb ..... A47F 5/0846 52/36.5
6,363,645 B1 * 4/2002 Hunter ..... A47F 5/0846 211/87.01
6,393,792 B1 * 5/2002 Mowery ..... E04F 13/18 52/549

(Continued)

*Primary Examiner* — James M Ference
(74) *Attorney, Agent, or Firm* — Cohen IP Law Group, PC; Michael N. Cohen

(57) ABSTRACT

A customizable cladding system is provided. The customizable cladding system includes one or more base plates designed to be attached to a support structure (e.g., a fence post, wall, etc.). The base plates include attachment mechanisms extending outward from their front surfaces. Cladding plates, including corresponding attachment mechanisms on their back sides, are then removable coupled to the base plates to form a customizable cladding. The structure of the customizable cladding may be modified at any time by removing the cladding plates and reconfiguring them with the base plates as desired.

15 Claims, 10 Drawing Sheets

(56) References Cited

U.S. PATENT DOCUMENTS 8,127,507 B1 * 3/2012 Bilge ..... E04F 13/0814 52/235
8,220,648 B2 * 7/2012 Barkdoll ..... A47F 5/0846 211/94.01
8,584,417 B1 * 11/2013 Krieger ..... E04F 13/0826 52/483.1
9,016,020 B1 * 4/2015 Yang ..... E04F 13/0803 52/511
9,359,770 B1 * 6/2016 Bilge ..... E04F 13/0812
9,469,999 B1 * 10/2016 Aboukhalil ..... E04F 13/083
10,094,105 B2 * 10/2018 Harnish ..... E04B 9/247
10,329,773 B1 * 6/2019 Ferguson ..... E04F 13/083
10,683,664 B2 * 6/2020 Langeveld ..... E04B 9/363
10,689,850 B2 * 6/2020 Langeveld ..... E04B 9/26
10,697,183 B1 * 6/2020 Ferguson ..... E04F 13/083
10,947,724 B2 * 3/2021 Langeveld ..... E04B 9/16
2004/0065038 A1 * 4/2004 Yuan ..... B21D 47/00 52/506.08
2006/0179744 A1 * 8/2006 Lynch ..... E04F 17/00 52/235
2007/0251181 A1 * 11/2007 Dupont ..... E04F 13/0805 52/586.1
2008/0010922 A1 * 1/2008 Wagner ..... E04F 13/0812 52/235
2009/0007515 A1 * 1/2009 Mercer ..... E04F 13/0862 52/766
2009/0241451 A1 * 10/2009 Griffiths ..... E04F 13/0889 52/309.4
2010/0186343 A1 * 7/2010 MacDonald ..... E04F 13/0889 52/747.1
2010/0263314 A1 * 10/2010 MacDonald ..... E04F 13/12 52/506.05
2012/0085042 A1 * 4/2012 Macdonald ..... E04F 13/0826 52/302.1
2012/0198788 A1 * 8/2012 MacDonald ..... E04F 13/12 52/747.1
2016/0102462 A1 * 4/2016 Griffiths ..... E04F 13/0862 52/550
2019/0024373 A1 * 1/2019 Langeveld ..... E04B 9/366
2019/0186134 A1 * 6/2019 Langeveld ..... E04F 13/083
2020/0011055 A1 * 1/2020 Langeveld ..... E04B 9/16
2021/0301525 A1 * 9/2021 Baxter ..... E04B 9/065

* cited by examiner

CUSTOMIZABLE CLADDING SYSTEM AND METHOD

FIELD OF THE INVENTION

This invention relates to cladding, including a customizable cladding system.

BACKGROUND

Wall cladding is used throughout the world on all types of buildings to provide thermal insulation and weather resistance, to improve the aesthetic appearance of the building, to define zones and structural elements, and for other purposes. Typically, the cladding is permanent in nature, and once installed, remain in place and with the same form and shape until the cladding is completely replaced. Replacement of such cladding structures is oftentimes costly and labor intensive.

Accordingly, there is a need for a customizable cladding system.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the system according to exemplary embodiments hereof includes a customizable cladding system. The cladding system generally includes one or more base plate assemblies that may be attached to desires support structures (e.g., a wall), and one or more cladding assemblies that may be attached to the base plates at various locations depending on the desired outcome. In this way, the system is customizable.

Figure 1:
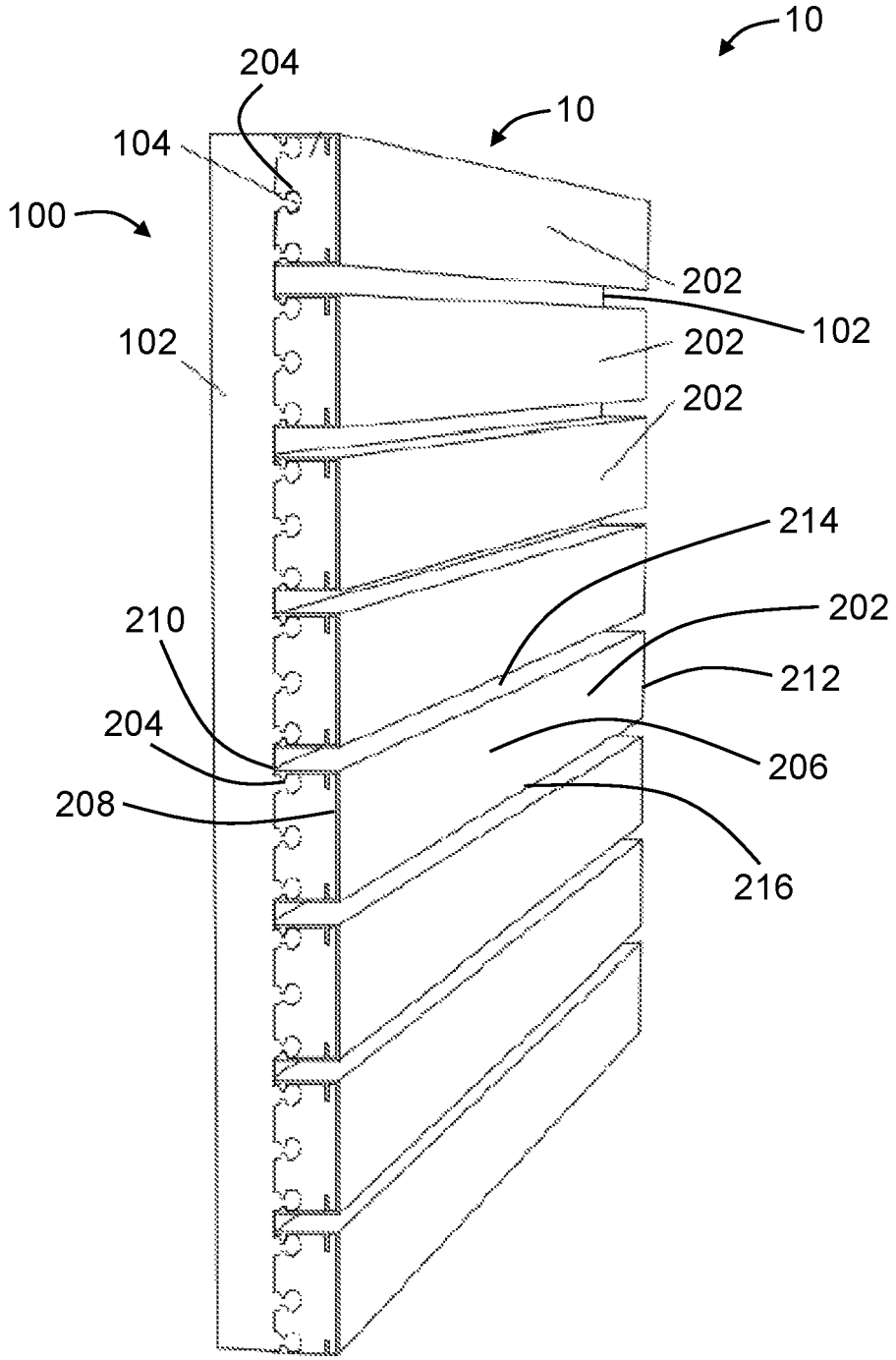
FIG. 1 shows a schematic of a customizable cladding system according to exemplary embodiments hereof.
Figure 2:
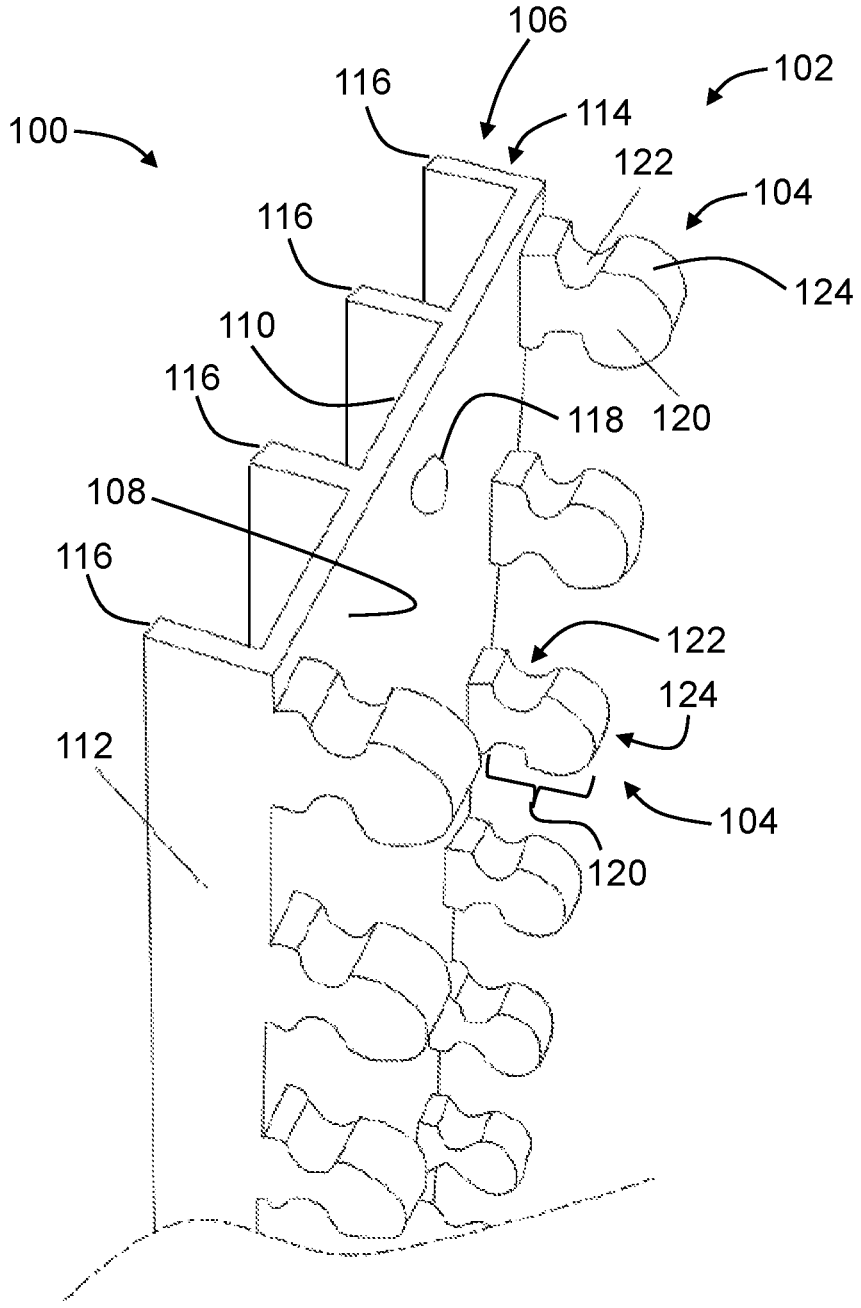
FIG. 2 shows a schematic of a support assembly according to exemplary embodiments hereof.

In one exemplary embodiment hereof, as shown in FIGS. 1 and 2, the customizable cladding system 10 (also referred to as simply the system 10) includes a support assembly 100 and a cladding assembly 200. In general, the support assembly 100 includes one or more base structures 102 that may be configured with one or more external support structures (e.g., walls, columns, etc.), and the cladding assembly 200 includes one or more cladding members 202 (e.g., panels, slats, etc.) that may be attached to, and extend between, the base structures 102. The base structures 102 each include first attachment mechanisms 104 and the cladding members 202 each include second attachment mechanisms 204, and the first and second attachment mechanisms 104, 204 facilitate the attachment of the cladding members 202 to the base structures 102. The system 10 also may include other elements as necessary to fulfill its functionalities.

It also is contemplated that the customizable cladding system 10 may be used as a barrier system, with the support assembly 100 configured with posts (e.g., fence posts), and the cladding assembly 200 extending between the posts. Accordingly, while this specification will describe the system 10 primarily in respect to its use as a cladding system, it is understood that the system 10 also may be used as a barrier system, and that its ultimate use does not limit the scope of the system 10 in any way.

Further details of the customizable cladding system 10, the support assembly 100, and a cladding assembly 200 will be described below in relation to FIGS. 1-7.

Support Plate Assembly 100

In some embodiments, as shown in FIG. 2, the support assembly 100 includes one or more base structures 102 each including a base plate 106 and first attachment mechanisms 104.

In some embodiments, the base plate 106 is generally elongate and includes a front surface 108, a rear surface 110, a left side 112, and a right side 114. The rear surface 110 is designed to be attached to a surface of an external support structure such as a wall. In this arrangement, the front surface 108 faces outward from the external support structure and includes the one or more first attachment mechanisms 104 for the attachment of the cladding assembly 200.

In some embodiments, the rear surface 110 includes one or more support ribs 116 extending orthogonally outward from the rear surface 110. It is preferable that the one or more support ribs 116 each extend the same distance from the rear surface 110 so that the distal ends of the ribs 116 are aligned along the same plane. In this way, the distal ends of the support ribs 116 may be placed against a surface of an external support structure and the base structure may be attached thereto. Once attached, the support ribs 116 may provide support to the base plate 106 across the width and length of the plate 106.

In some embodiments, the base plate 106 includes an elongate secondary U-shaped channel member that may facilitate the attachment of the plate 106 to the supporting structure. In this case, the U-shaped channel member may be secured vertically to the side of the support structure with the channel facing outwards, and the support ribs 116 may be received into the channel and secured therein. In another embodiment of this type, the far left and right support ribs 116 may extend adjacent the left and right walls of the U-shaped channel (either outside the channel walls or inside the channel walls) and be secured thereto. In this way, the base plate 106 may be secured to the support structure.

In some embodiments, the base plate 106 includes one or more through-hole(s) 118 through which a screw, bolt, nail, or other type of securing mechanism may pass to secure the plate 106 to the external support structure. However, it is understood that the base plate 106 may be attached to an external support structure using other types of attachment techniques (e.g., adhesive, welding, etc.) and that the scope of the system 10 is not limited in any way by the way in which the base plate 106 is secured to the external support structure.

In some embodiments, the base plate 106 includes one or more first attachment mechanisms 104 coupled to its front surface 108 and extending outward therefrom.

As will be described herein, the first attachment mechanisms 104 are designed to releasably attach to the second attachment mechanisms 204 (of the cladding assembly 200) in order to releasably secure the cladding members 202 to the base structures 102. For example, in some embodiments, the first attachment mechanisms 104 may include a generally male interlocking profile and the second attachment mechanisms 204 may include a generally female interlocking profile so that the male and female interlocking profiles may mate and attach to one another. It also is contemplated that these profiles may be reversed and that the first attachment mechanisms 104 may include female interlocking profiles and the second attachment mechanisms 204 may include male interlocking profiles, and/or any combinations thereof.

Figure 3:
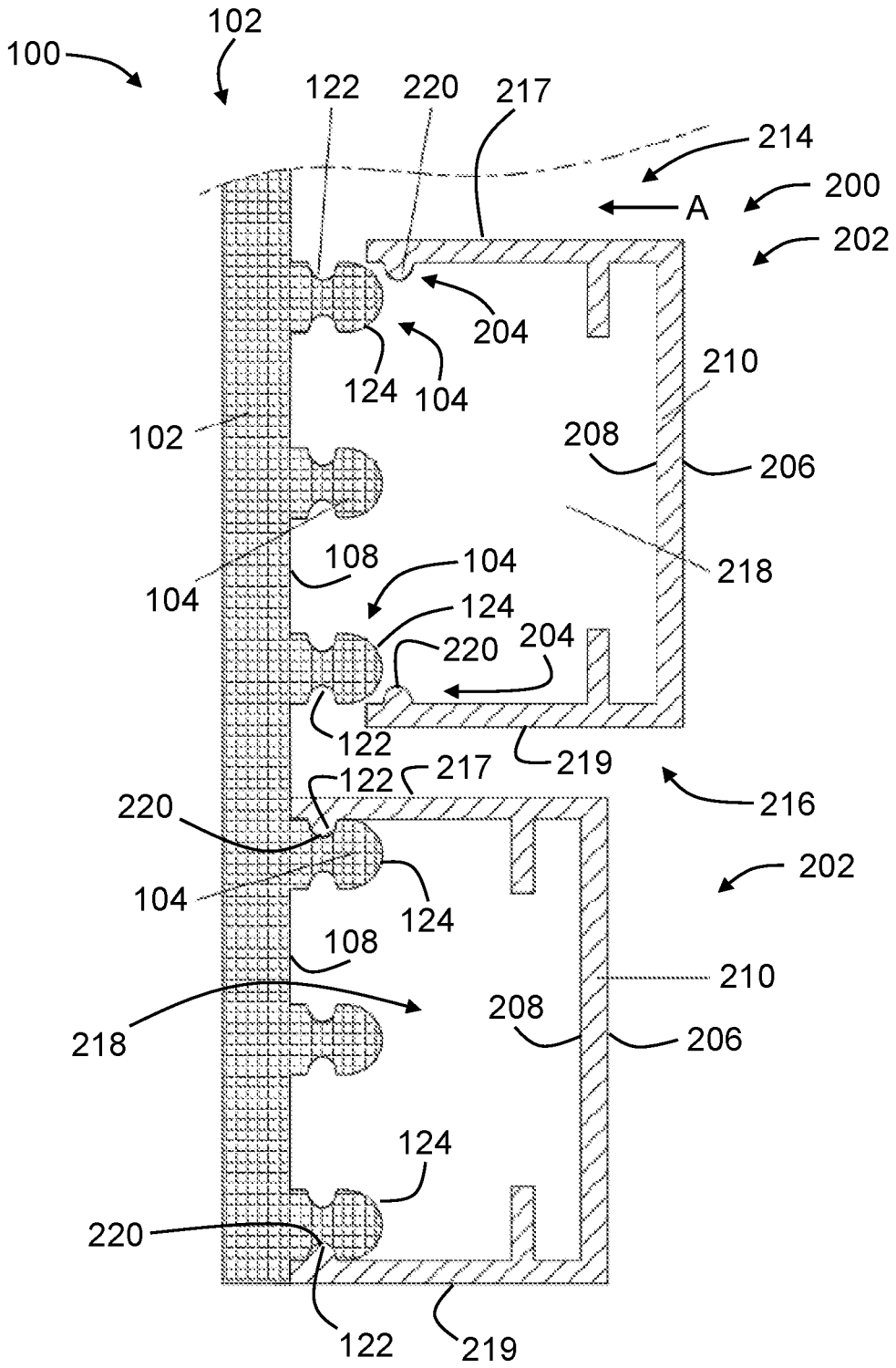
FIG. 3 shows a side view of a customizable cladding system according to exemplary embodiments hereof.

Expanding on this concept, in some embodiments, as shown in FIGS. 2 and 3, the first attachment mechanisms 104 each may include an attachment mechanism body 120 with a proximal end attached to the front surface 108 of the base plate 106 and a distal end extending outward therefrom. The distal end may include a head 124 with a neck 122 positioned between the head 124 and the plate 106.

In some embodiments, the head 124 includes an outward convex curvature as shown in FIGS. 2 and 3. However, it also is contemplated that the outer curvature of the head 124 include an arrow, a point, a square with rounded corners, a trapezoid, other suitable shapes and/or forms, and any combinations thereof. As will be described in other sections, the head 124 is shaped to enable the second attachment mechanism 204 to slide past the head 124 and to subsequently engage with the neck 122.

In some embodiments, the neck 122 includes an inward concave curvature as shown in FIGS. 2 and 3. However, it also is contemplated that inward curvature of the neck 122 include a notch (e.g., a V-, U-, or arc-shaped notch), a square with rounded corners, a trapezoid, ledge (e.g., right angled or slanted), other suitable shapes and/or forms, and any combinations thereof. As will be described in other sections, the neck 122 is shaped to receive a corresponding element on the second attachment mechanism 204 in order to mate and connect the first and second attachment mechanisms 104, 204 together.

In some embodiments, the cross-sectional shape of the first attachment mechanism's body 120 is square or rectangular shaped. In this case, the neck's inward curvature may extend around the entire cross-sectional perimeter of the mechanism's body 120 or may be placed at desired areas on the body's cross-sectional perimeter, e.g., on the top and bottom sides of the body 120 as shown in FIG. 2. In other embodiments, the cross-sectional shape of the first attachment mechanism's body 120 is circular or oval shaped, and the neck's inward curvature may extend around the entire cross-sectional circumference of the mechanism's body 120 or may be placed at desired areas on the body's cross-sectional circumference, e.g., on the top and bottom sides of the body 120. It also is contemplated that the mechanism's body 120 include other cross-sectional shapes and that the neck's inward curvature may be placed at any desired locations as required.

In some embodiments, as shown in FIG. 2, the first attachment mechanisms 104 are arranged on the plate's front surface 108 as a matrix of rows and columns. For example, as shown in FIG. 2, the matrix may include two side-by-side columns of first attachment mechanisms 104 separated by a predetermined distance (e.g., 6"-12"). Each row also may be separated by a predefined distance (e.g., 2") and the number of rows may depend on the height of the base plate 106. In some embodiments, the vertical spacings between the rows of mechanisms 104 are constant while in other embodiments the spacings may differ from one pair of rows to the next. The side-by-side columns preferably match and are aligned vertically so that the rows are generally horizontal. In this way, as will be described in other sections, the corresponding second attachment mechanisms 204 may be correspondingly aligned to facilitate the easy alignment, placement, and engagement of the first and second attachment mechanisms 104, 204 together.

While FIG. 2 shows two side-by-side columns of first attachment mechanisms 104, it is understood that a base plate 106 may include any number of columns of first attachment mechanisms 104 (with each column including any number of first attachment mechanisms 104 depending on the height of the base plate 106) and that scope of the system 10 is not limited in any way by the number(s) of columns of first attachment mechanisms 104 on any particular base plate 106.

In some embodiments, as shown in FIG. 2, a first column of first attachment mechanisms 104 may be positioned on or towards the left side 112 of a base plate 106 and a second column of first attachment mechanisms 104 may be positioned on or towards the right side 114 of the base plate 106. However, it is understood that the columns of first attachment mechanisms 104 may be positioned anywhere on a base plate 106 as required.

Cladding Assembly 200

In some embodiments, as shown in FIGS. 1 and 3, the cladding assembly 200 includes one or more cladding members 202 (e.g., panels, plates, slats, etc.) configured to attached to, and extend between, the base structures 102. Each cladding member 202 includes a front side 206, a back side 208, a left side 210, a right side 212, a top side 214, and a bottom side 216. While the cladding members 202 in FIG. 1 are shown as generally rectangular cuboids, it is understood that the cladding members 202 may be formed as any suitable shapes.

FIG. 3 shows a side view of the system 10 looking directly into the left side of the system 10 of FIG. 1. In some embodiments, as shown in FIG. 3, each cladding member 202 is designed to mate with a corresponding base structure 102.

In some embodiments, as shown in FIG. 3, the cladding member's top side 214 and bottom side 216 include sidewalls 217, 219, respectively, that extend backwards from the member's back side 208. In this way, the member's top side sidewalls 217, back side 208, and bottom side sidewalls 219 define an inner cavity 218 about the member's back side 208.

In some embodiments, the top side sidewalls 217 and/or the bottom side sidewalls 219 form second attachment mechanisms 204 by including tabs 220 on their inner surfaces facing into the inner cavity 218. In some embodiments, the tabs 220 generally correspond in shape to the inward curvatures on the first attachment mechanism's neck 122. In this way, the tabs 120 may be received into the first attachment mechanism's neck 122 and be releasably held therein. In some embodiments, the tabs 120 may be elongate and may extend from the cladding member's left side 210 to its right side 212 and/or any portion thereof, and preferably at locations that correspond to the placement of the first attachment mechanisms 104 when the system 10 is fully erected.

For further clarification, FIG. 3 shows an upper cladding member 202 slightly dislodged from the corresponding base member 102, and a lower cladding member 202 releasably interlocked with the corresponding base member 102. When interlocked, it may be preferable that the distal end of the top side sidewalls 217 and the distal end of the bottom side sidewall 219 generally abut or otherwise engage the front surface 108 of the base member 102. In this arrangement, the first and second attachment mechanisms 104, 204 are interlocked, and the first attachment mechanisms' bodies 120 are received into the cladding member's inner cavity 218.

To secure the upper cladding member 202 to the base member 102, the upper cladding member 202 is aligned with the corresponding first attachment mechanisms 104 and moved in the direction of the arrow A. As the cladding member 202 is moved in this direction, the tabs 204 (upper and lower) may engage the head 124 of the corresponding first attachment member 104. As the cladding member 202 continues to move towards the base member 106, the cladding member's upper side 214 and lower side 216 may flex (deflect) slightly outward thereby enabling the tabs 204 to pass over the corresponding heads 124 and subsequently be received into the corresponding necks 122 (into the inward curvatures). This results in the cladding member 202 being mated with the base member 102 as represented by the lower cladding member 202 in FIG. 3.

To remove the cladding member 202 from the base structure 102, the cladding member 202 may be moved in a direction generally opposite the direction of the arrow A such that the cladding member's upper side 214 and lower side 216 flex slightly outward thereby allowing the tabs 120 to dislodge from the necks 122.

In some embodiments, the distance between the cladding member's top side 214 and bottom side 216 is chosen to generally correspond to the distance between two rows of first attachment mechanisms 204. As shown in FIG. 3, the distance between the cladding member's top and bottom sides 214, 216 is chosen to generally correspond to the distance between a first row of first attachment mechanisms 104 and a third row of first attachment mechanisms 104 thereby skipping the second row of first attachment mechanisms 104. Notably, the second row of attachment mechanisms 104 may not be utilized in this arrangement and may simply be received into the cladding member's backside cavity 218.

Figure 4:
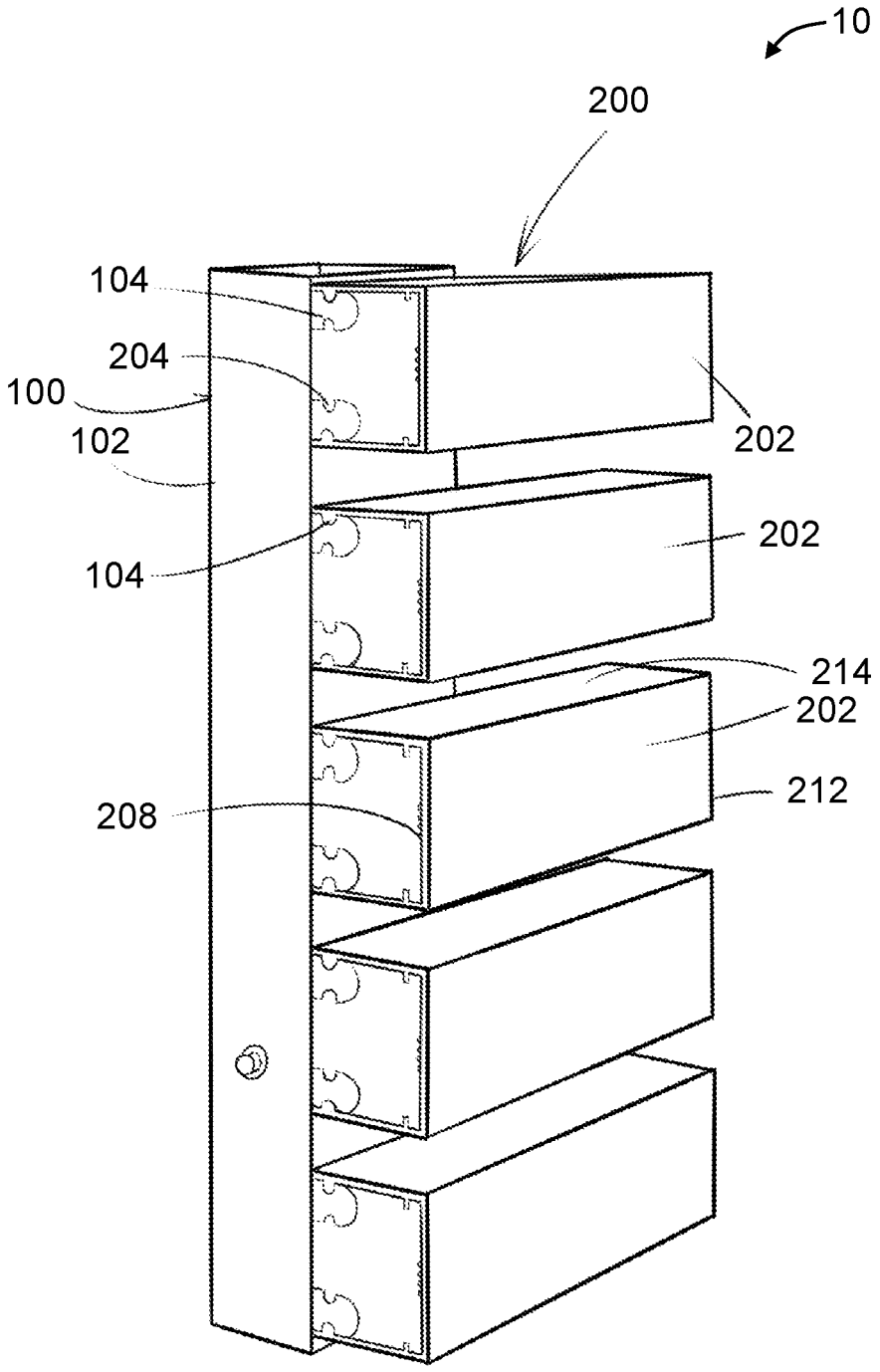
FIGS. 4-8 show schematic views of customizable cladding systems according to exemplary embodiments hereof.
Figure 5:
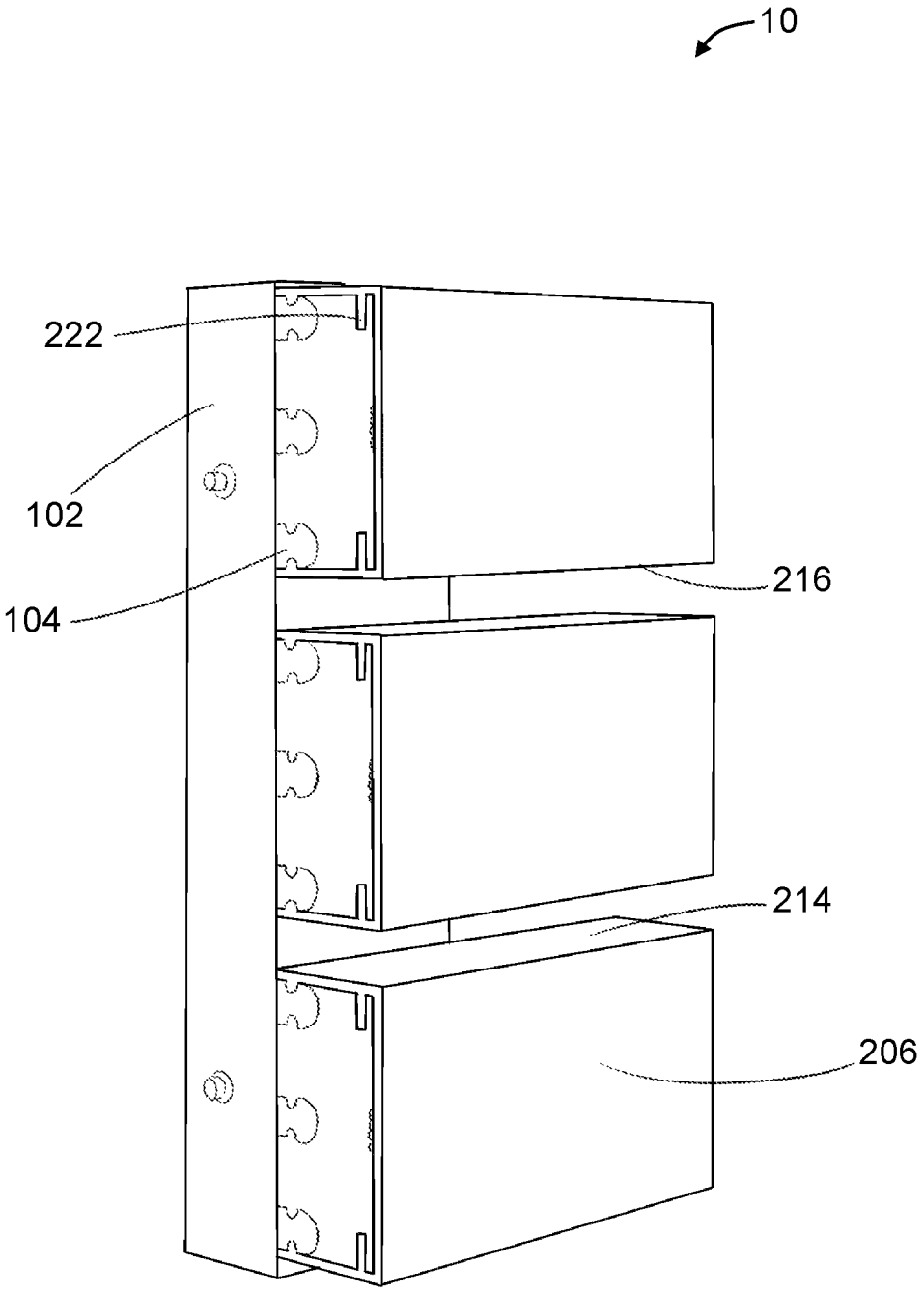
Figure 6:
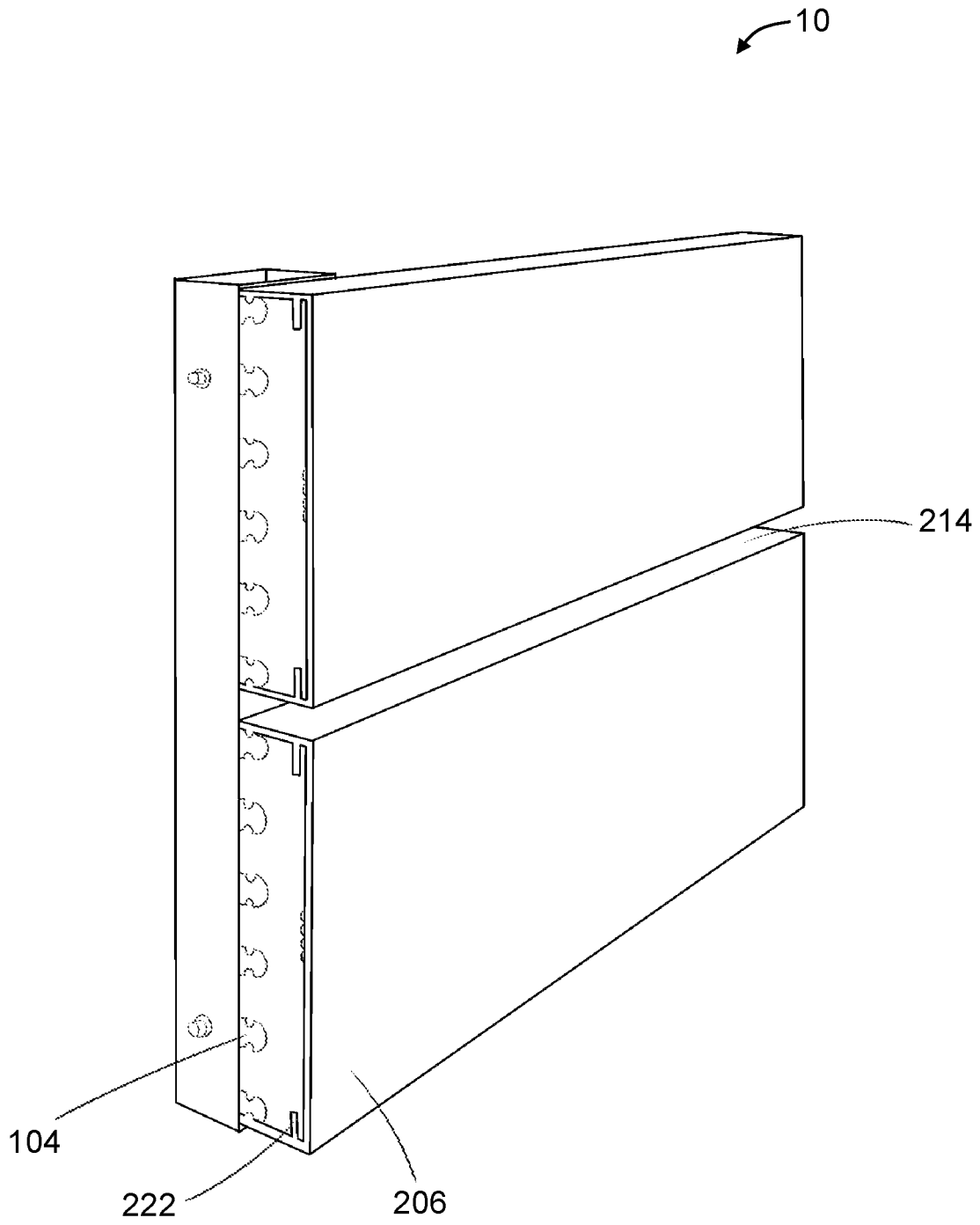
Figure 7:
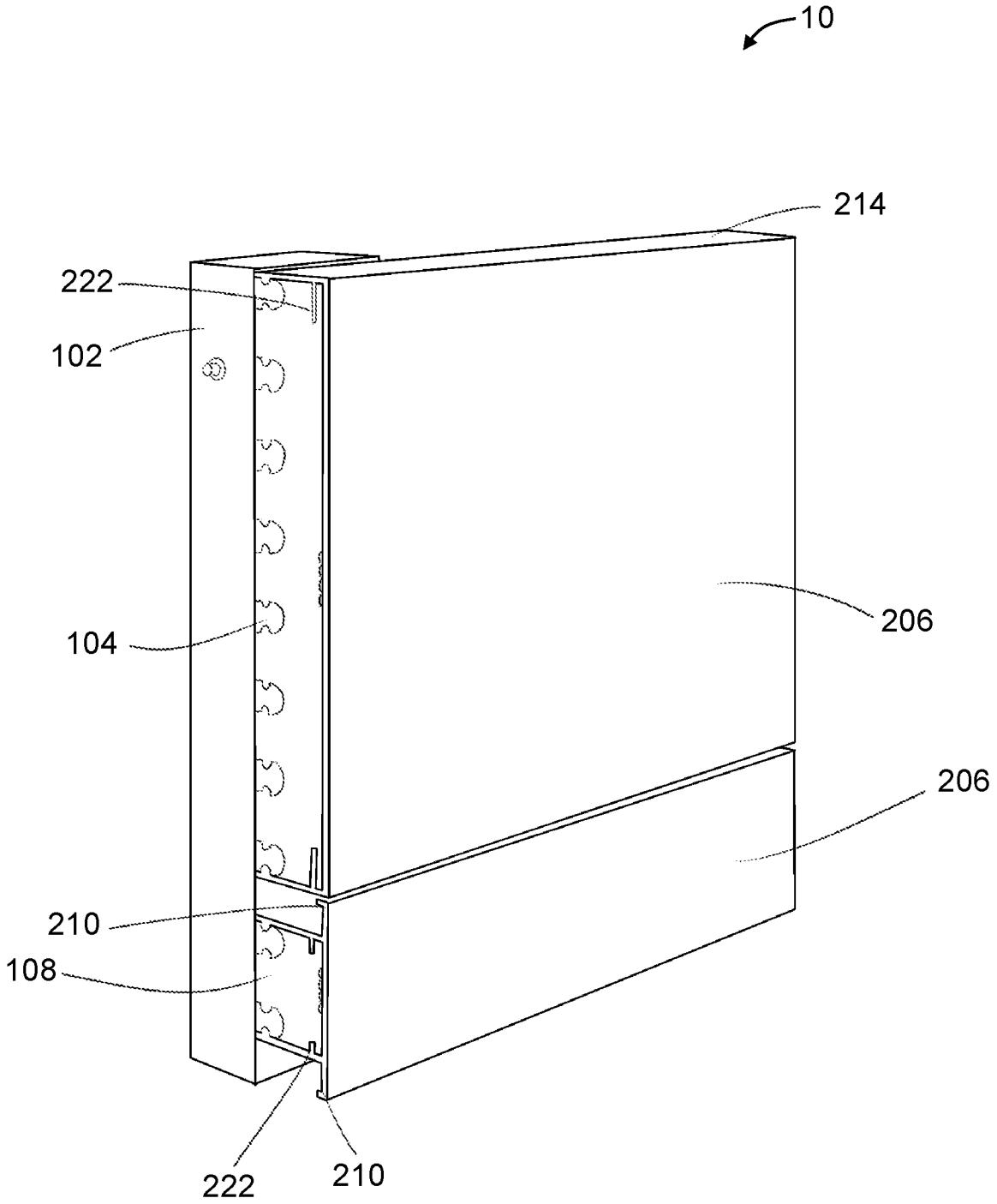

It can be seen that the height of each cladding member 202, and therefore the distance between the member's top and bottom sides 214, 216, may preferably be chosen to be correspond to the distance between any two rows of first attachment mechanisms 104. In this way, an upper row of first attachment mechanisms 104 may be engaged with a second attachment mechanism 204 configured with the cladding member's top side 214, a lower row of first attachment mechanisms 104 may be engaged with a second attachment mechanism 204 configured with the cladding member's bottom side 216, and the intermediary rows (if existing) may be received into the cladding member's backside cavity 218. For example, FIG. 4 shows a cladding members 202 configured with adjacent rows of first attachment mechanisms 104, FIG. 5 shows cladding members 202 configured with first and third rows of first attachment mechanisms 104 (with one intermediary row of first attachment mechanisms 104 therebetween, generally un-utilized, and received into the cladding member's backside cavity 218), FIG. 6 shows cladding members 202 configured with first and sixth rows of first attachment mechanisms 104 (with four intermediary rows of first attachment mechanisms 104 therebetween, generally un-utilized, and received into the cladding member's backside cavity 218), and FIG. 7 shows a first cladding member 202 configured with first and eighth rows of first attachment mechanisms 104 (with six intermediary rows of first attachment mechanisms therebetween, generally un-utilized, and received into the cladding member's backside cavity 218) and a second cladding member 202 configured with first and second rows of first attachment mechanisms 104.

Figure 8:
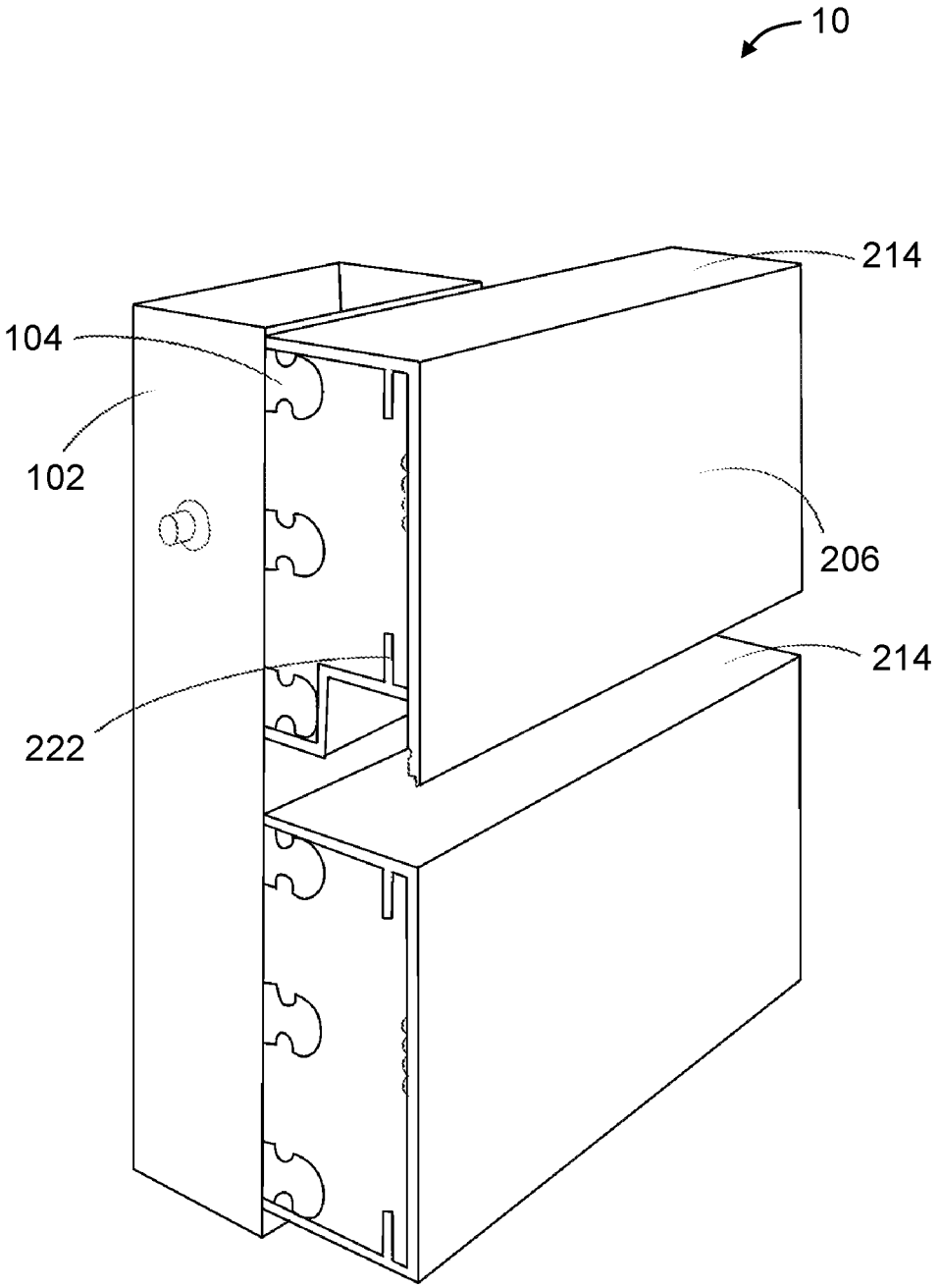

In some embodiments, as shown in FIG. 3, cladding member's top side 214 and/or bottom side 216 may extend generally linearly from the member's front side 206 to its back side 208. However, in other embodiments, as shown in FIG. 8, the top and/or bottom sides 214, 216 may include non-linear elements. For example, in some embodiments, the top and/or bottom sides 214, 216 may include curvatures, right angles, etc. For example, the lower cladding member 202 shown in FIG. 8 includes a lower elongate cavity formed by its bottom side 216 that extends from its left side 210 to its right side 212. This channel may be configured to receive lighting elements (e.g., a string of lights that extends the length of the cladding member 202), electrical lines, other types of elements, and/or any combinations thereof.

Figure 9:
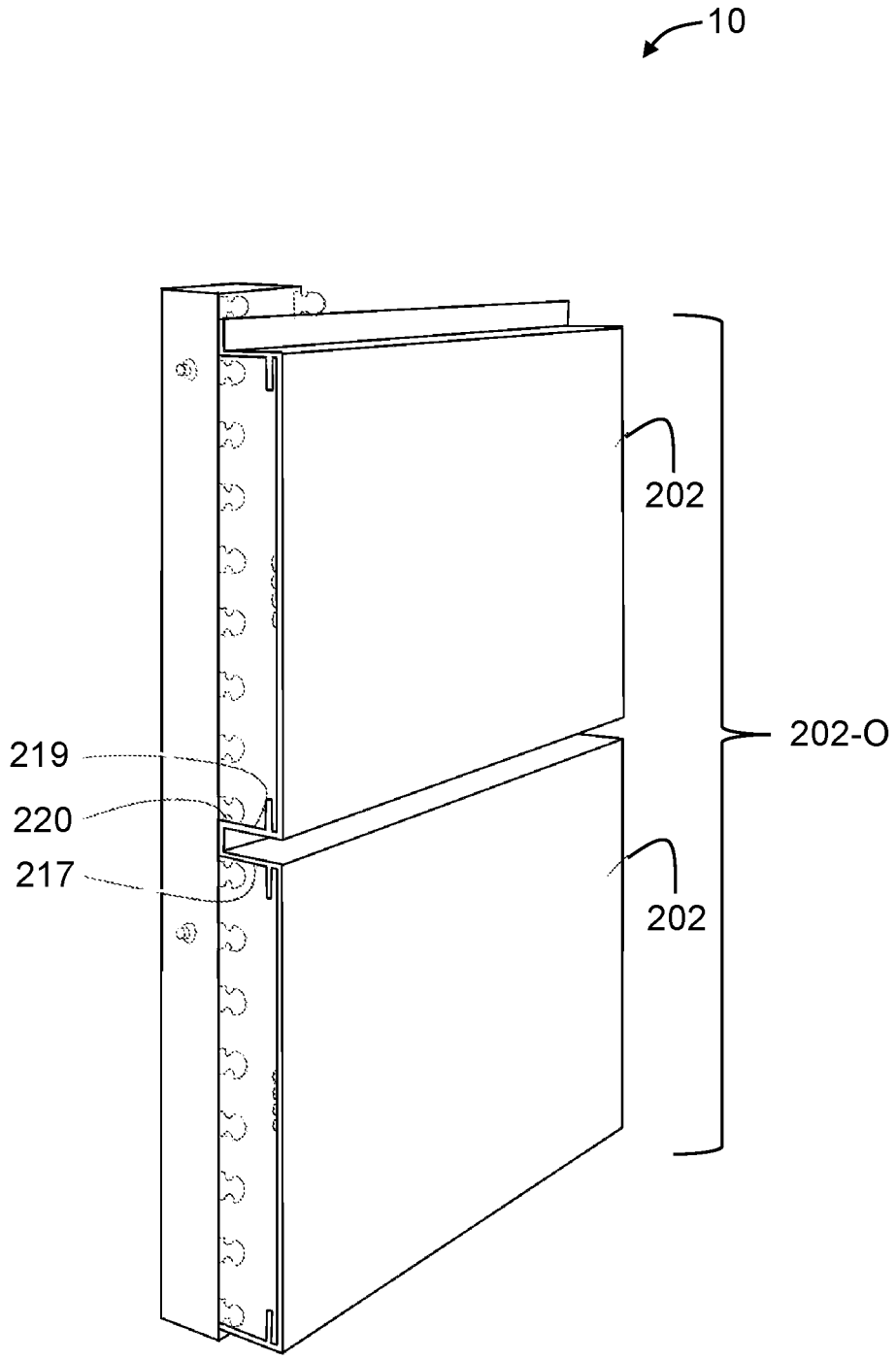
FIG. 9 shows a schematic view of a customizable cladding system including an overall cladding member according to exemplary embodiments hereof.

In some embodiments, as shown in FIG. 9, a first cladding member's bottom side sidewall 219 may be joined with a second cladding member's top side sidewall 217 to form an overall cladding member 202-O. For example, as shown in FIG. 9, the distal end of the first member's bottom side sidewall 219 may be joined to the distal end of the second member's top side sidewall 217 by a section of cladding member material. Notably, because the sidewalls 219, 217 are joined, one or both of the sidewalls 219, 217 may include a tab 220 that interlocks with a corresponding neck 122. For example, FIG. 9 shows the first member's bottom side sidewall 219 as including a tab 220 and the second member's top side sidewall 217 as not including a tab 220. It is understood that any number of cladding members 202 may be combined in this manner to form overall cladding members 202-O with any number of combined bottom side sidewalls 219 and top side sidewalls 217.

It is understood that cladding members 202 of different sizes may be configured together on common base structures 102 in any combinations as desired.

Figure 10:
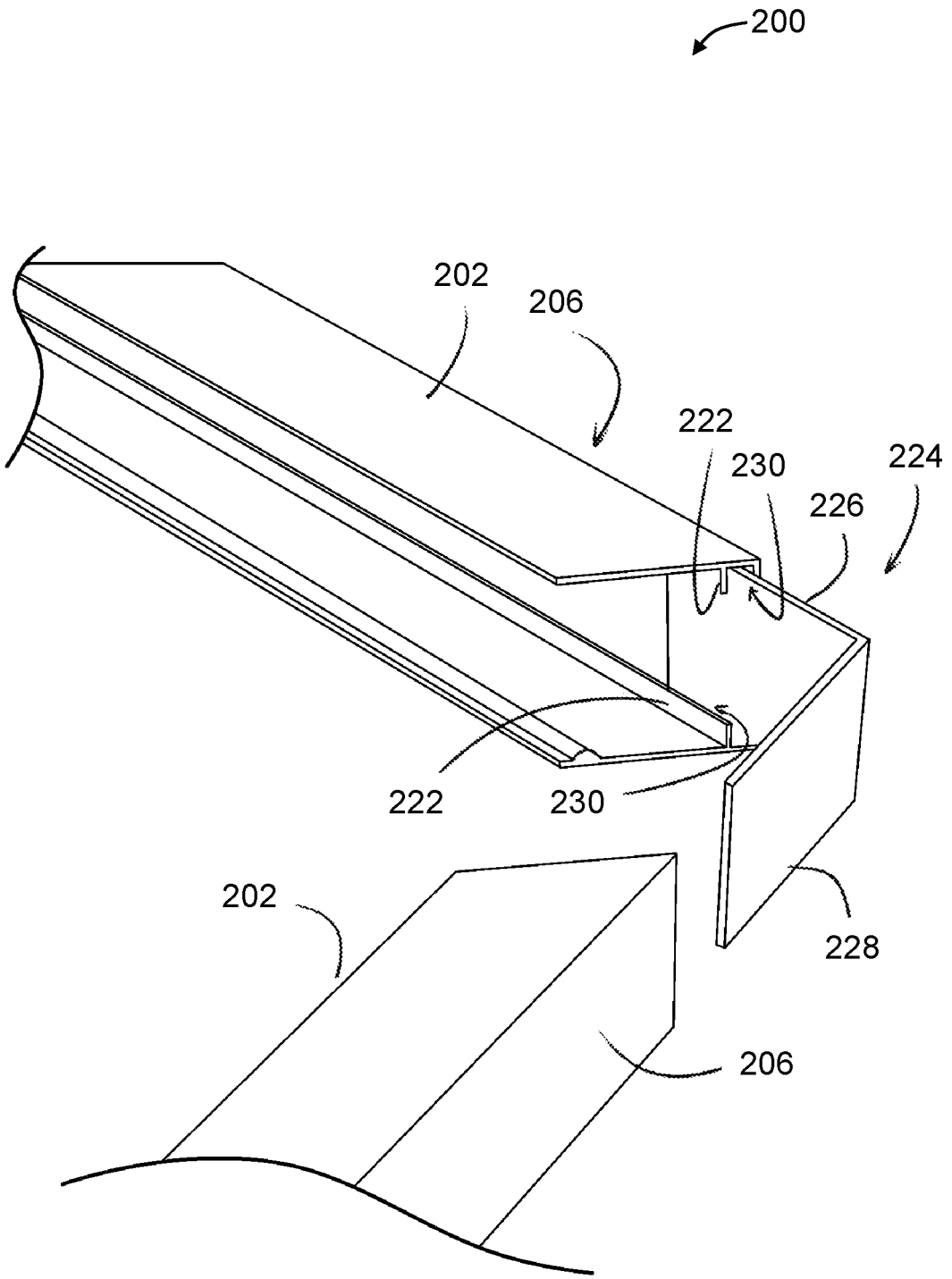
FIG. 10 shows two cladding members and a connecting plate according to exemplary embodiments hereof.

In some embodiments, as shown in FIG. 10, the system 10 includes one or more connecting plates 224 designed to connect two cladding members 202 end-to-end. In some embodiments, the connecting plates 224 are used to connect two cladding members 202 end-to-end at an angle as shown in FIG. 10, while in other embodiments, the connecting plates 224 may be used to connect two cladding members 202 end-to-end in a generally straight configuration.

In some embodiments, as shown in FIG. 10, each connecting plate 224 includes a first end 226 and a second end 228 that may (or may not) be offset by an angle. In some embodiments, the cladding members 202 include inner channels 222 designed to receive an end 226, 228 of a connecting plate 224. For example, a first cladding member 202 may receive a first end 226 of a connecting plate 224, and a second cladding member 202 may receive a second end 228 of the connecting plate 224. In this way, the connecting plate 224 extends from within the first cladding member 202 to within the second cladding member 202 thereby connecting the ends of the cladding members 202 together.

In some embodiments, as shown in FIG. 10, each cladding member 202 includes an internal channel 230 formed between the back side 208 of the cladding member 202 and an internal rib 222 extending inward from the cladding member's top side sidewall 217 and/or from the cladding member's bottom side sidewall 219. In some embodiments, the internal rib 222 is orthogonal to the sidewall 217, 219 from which it extends, and extends from the left side 210 to the right side 212 of a cladding member 202, or any portions thereof.

In some embodiments, each internal channel 230 is designed to receive an end 226, 228 of a connecting plate. For example, as shown in FIG. 10, a first cladding member (e.g., the upper member 202 in FIG. 10), includes an upper internal channel 230 formed between the upper rib 222 and the back side 208 of the cladding member 202, and a lower internal channel 230 formed between the lower rib 222 and the back side 208 of the cladding member 202. As shown, the upper internal channel 230 and the lower internal channel 230 are opposing and designed to together receive a first end 226 of the connecting plate 224. In some embodiments, the upper internal channel 230 receives an upper edge of the plate's first end 226 and the lower internal channel 230 receives a lower edge of the plate's first end 226. It may be preferable that the width of each internal channel 230 generally match the width of the connecting plate 224 so that the connecting plate 224 fits within the channels 230 snug.

In some embodiments, the ribs 222 extend inward from each respective inner surface of the top side sidewall 217 and/or the bottom side sidewall 219 a distance adequate to hold each side 226, 228 of the connecting plate 224 secure. For example, in some embodiments, the ribs 222 may extend inward about ⅛" to about 1" and preferably about ½".

It is understood that the second cladding member 202 (e.g., the lower member 202 in FIG. 10) includes a similar arrangement of upper and lower ribs 222 forming corresponding upper and lower internal channels 230, and that the upper and lower channels 230 are opposing and designed to together receive the second end 228 of the connecting plate 224. Once the connecting plate 224 is received into the ends of the first and second cladding members 202, the cladding members 202 may be pushed together to abut end-to-end while being held in place by the connecting plate 224 configured therein.

It may be preferable that the respective ends of the cladding members 202 that are abutted in this arrangement include miter cuts as necessary that generally correspond to the angle between the connecting plate's first and second ends 226, 228 so that the ends of the cladding members 202 may abut without gaps or disconnects.

In some embodiments, the connecting plate's first and second ends 226, 228 are offset from one another by an angle of 90° thereby enabling the cladding system 10 to be configured with a corner of a support structure (e.g., an outer corner of a wall). In this example, a first base structure 102 may be configured with the wall to one side of the outward corner, and a second base structure 102 may be configured with the wall to the other side of the outward corner. A first cladding member 202 may be configured with first base structure 102 and a second cladding member 202 may be configured with the second base structure, and the first and second cladding members 202 may be connected to one another using a connecting plate 224 (e.g., as shown in FIG. 10).

In some embodiments, the base structures 102 and/or the cladding members 202 comprise metal (e.g., aluminum, steel, etc.), plastic, wood, composite materials, other suitable materials, and any combinations thereof.

While FIG. 1 shows cladding members 202 configured between two side-by-side vertical base structures 102, it is understood that the cladding members 202 may be configured between any number of base structures 102.

While the system 10 has been described as oriented generally vertically, it also is understood that the system 10 may be oriented sideways, diagonally, and/or in any other desired orientation(s).

It is understood that any aspect and/or element of any embodiment of the system 10 described herein or otherwise may be combined with any other aspect and/or element of any other embodiment described herein or otherwise in any way to form additional embodiments of the system 10 all of which are within the scope of the system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs" and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to" and are not intended to exclude other components unless specifically so stated.

It will be appreciated that variations to the embodiments of the invention can be made while still falling within the scope of the invention. Alternative features serving the same, equivalent, or similar purpose can replace features disclosed in the specification, unless stated otherwise. Thus, unless stated otherwise, each feature disclosed represents one example of a generic series of equivalent or similar features.

The present invention also covers the exact terms, features, values, and ranges, etc. in case these terms, features, values, and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A customizable cladding system comprising:

a base plate including a base plate front side and a base plate back side opposite the base plate front side;

at least one first attachment mechanism with a first end coupled to the base plate front side and a second end opposite the first end and extending away from the base plate back side and including an inward curvature;

a panel including a panel front side and a panel back side; and at least one second attachment mechanism including a sidewall with a first sidewall end coupled to the panel back side and a second sidewall end extending outward therefrom, and including an outward extending tab located between the first sidewall end and the second sidewall end;

wherein the inward curvature is adapted to receive the outward extending tab thereby releasably attaching the panel to the base plate with the second sidewall end abutted against the base plate front side;

wherein the second sidewall end terminates at a second sidewall far end, and the second sidewall far end abuts against the base plate front side when the outward extending tab is received into the inward curvature; and wherein the sidewall extends linearly from the panel back side to the second sidewall far end.

2. The customizable cladding system of claim 1 wherein the at least one first attachment mechanism includes a plurality of first attachment mechanisms arranged in rows and columns coupled to the base plate front side.

3. The customizable cladding system of claim 2 wherein the base plate includes a first left side and a first right side, and wherein a first column of first attachment mechanisms is coupled to the base plate front side towards the first left side and a second column of first attachment mechanisms is coupled to the base plate front side towards the first right side.

4. The customizable cladding system of claim 1 wherein the at least one first attachment mechanism includes a head distal to the inward curvature, the head including a distal convex curvature.

5. The customizable cladding system of claim 4 wherein the at least one second attachment mechanism is adapted to deflect over the head to be received into the inward curvature.

6. The customizable cladding system of claim 1 wherein the sidewall is orthogonal to the panel back side.

7. A customizable cladding system comprising:

a base plate including a base plate front side and a base plate back side;

at least one first attachment mechanism coupled to and extending from the base plate front side and including an inward curvature;

a panel including a panel front side and a panel back side; and at least one second attachment mechanism including a sidewall with a first sidewall end coupled to the panel back side and a second sidewall end extending outward therefrom, and including an outward extending tab located between the first sidewall end and the second sidewall end;

wherein the inward curvature is adapted to receive the outward extending tab thereby releasably attaching the panel to the base plate with the second sidewall end abutted against the base plate front side; and a rib coupled to and extending outward from the sidewall, the rib forming a first channel between the rib and the panel back side.

8. The customizable cladding system of claim 7 further comprising a connecting plate including a first edge adapted to be received into the first channel.

9. The customizable cladding system of claim 7 wherein the at least one first attachment mechanism includes a plurality of first attachment mechanisms arranged in rows and columns coupled to the base plate front side.

10. The customizable cladding system of claim 9 wherein the base plate includes a first left side and a first right side, and wherein a first column of first attachment mechanisms is coupled to the base plate front side towards the first left side and a second column of first attachment mechanisms is coupled to the base plate front side towards the first right side.

11. The customizable cladding system of claim 7 wherein the at least one first attachment mechanism includes a head distal to the inward curvature, the head including a distal convex curvature.

12. The customizable cladding system of claim 11 wherein the at least one second attachment mechanism is adapted to deflect over the head to be received into the inward curvature.

13. A customizable cladding system comprising:

a base plate including a base plate front side and a base plate back side opposite the base plate front side;

at least one first attachment mechanism coupled to and extending from the base plate front side away from the base plate back side and including an inward curvature;

a panel including a panel front side and a panel back side; and at least one second attachment mechanism including a sidewall with a first sidewall end coupled to the panel back side and a second sidewall end extending outward therefrom and terminating at a second sidewall far end, and including an outward extending tab located between the first sidewall end and the second sidewall far end;

wherein the inward curvature is adapted to receive the outward extending tab thereby releasably attaching the panel to the base plate; and wherein the sidewall extends linearly from the panel back side to the second sidewall far end.

14. The customizable cladding system of claim 13 wherein the second sidewall far end abuts against the base plate front side when the outward extending tab is received into the inward curvature.

15. The customizable cladding system of claim 13 wherein the sidewall from the panel back side to the second sidewall far end is orthogonal to the panel back side.

* * * * *